United States Patent [19]

Hardy

[11] Patent Number: 4,631,912

[45] Date of Patent: Dec. 30, 1986

[54] INITIAL THREADING FOR VACUUM SPINNING

[75] Inventor: N. Page Hardy, Keysville, Va.

[73] Assignee: Burlington Industries, Inc., Greensboro, N.C.

[21] Appl. No.: 732,319

[22] Filed: May 9, 1985

[51] Int. Cl.[4] ..... D01H 15/02; D01H 5/28; B65H 51/16

[52] U.S. Cl. ..... 57/279; 57/261; 57/280; 57/328; 57/333; 57/350; 226/7; 226/97

[58] Field of Search ..... 57/328, 333, 279, 280, 57/261, 263, 350; 226/7, 97

[56] References Cited

U.S. PATENT DOCUMENTS

| | | | |
|---|---|---|---|
| 3,445,995 | 5/1969 | Bell et al. | 57/279 |
| 3,511,041 | 5/1970 | Korikovsky et al. | 57/279 |
| 3,577,721 | 5/1971 | Schmick et al. | 57/280 |
| 3,605,396 | 9/1971 | Guignard et al. | 57/279 |
| 4,026,095 | 5/1977 | Kobatake et al. | 57/279 |
| 4,047,372 | 9/1977 | Horstmann et al. | 57/279 |
| 4,170,101 | 10/1979 | Bock | 57/261 X |
| 4,408,442 | 10/1983 | Rohner | 57/261 X |
| 4,507,913 | 4/1985 | Morrison | 57/328 |
| 4,543,776 | 10/1985 | Seiki et al. | 57/261 |
| 4,550,560 | 11/1985 | Tanaka et al. | 57/279 X |

*Primary Examiner*—John Petrakes

*Attorney, Agent, or Firm*—Nixon & Vanderhye

[57] ABSTRACT

An initial threading mechanism provides for simple but effective threading of the elongated hollow shaft of a vacuum spinning apparatus. Connected textile fibers are fed into the first end of the elongated hollow shaft, into the passageway which extends through the shaft from its first end to a second end. A vacuum tube is mounted for rotation about an axis parallel to and spaced from the axis of rotation of the hollow shaft. When a first open end of the vacuum tube is pivoted into an operative position adjacent the second end of the shaft, and in alignment with the shaft passageway, the vacuum tube connects up to a source of vacuum and draws a segment of the connected fibers completely through the passageway. The shaft includes perforations which normally are in operative communication with a vacuum source applied to the circumferential exterior of the shaft, however during rotation of the vacuum tube into its operative position an electrical switch is actuated causing a solenoid operated valve to cut off the application of vacuum to the circumferential exterior of the shaft. Once a segment of connected fibers has been drawn through the shaft passageway the vacuum tube is pivoted back to its original position, and the segment of fibers is connected to a take-up mechanism.

19 Claims, 5 Drawing Figures

INITIAL THREADING FOR VACUUM SPINNING

BACKGROUND AND SUMMARY OF THE INVENTION

Apparatus and a method for the production of yarn having properties approaching that of ring spun yarn, only at significantly greater speeds and with other significant operational advantages (such as automatic elimination of lint fly or oily waste) has been disclosed in U.S. Pat. No. 4,507,913 and commonly assigned copending application Ser. No. 677,487 filed Dec. 3, 1984. This advantageous new procedure for the spinning of yarn has been denoted "vacuum spinning". In the practice of vacuum spinning, an elongated tubular shaft having first and second ends with a through-extending passageway from the first end to the second end is mounted for rotation about an axis. At least a portion of the circumference of the shaft is perforated, and a vacuum source applies a vacuum to the exterior of the shaft as the shaft is rotated about its axis. A sliver or roving is passed into the shaft, and the vacuum causes at least some of the fibers or free ends of fibers passing through the shaft to be drawn toward the shaft perforations, so that they will be caused to rotate with the shaft as the fibers move linearly generally along the axis of rotation. The yarn that is formed is withdrawn from the second end of the shaft.

While vacuum spinning is a generally low maintenance procedure, during the initial start up there are difficulties in threading the fibers through the shaft passageway to the take-up mechanism. The procedure is not self-starting, and typically has been accomplished in the past by using a thread-up wire attached to the end of the fibers and manually pushing and pulling the thread-up wire through the passageway until the fibers were completely through the passageway. Then the fibers were wrapped around a take-up cone, or like take-up mechanism.

According to the present invention a method and apparatus are provided which greatly facilitate the initial threading of a vacuum spinning system elongated hollow shaft. According to the present invention initial threading is provided in an efficient semi-automatic procedure.

According to one aspect of the present invention, initial threading apparatus is provided comprising a cooperating vacuum reservoir having walls, and a vacuum tube having first and second ends. The vacuum reservoir is connected up to a source of vacuum. Means are provided for defining an opening in one of the reservoir walls, and means are provided for mounting the vacuum tube for rotation with respect to the reservoir so that the second end of the tube is movable from a first, inoperative, position wherein it is spaced from the opening, to a second, operative, position wherein it is in operative communication with the opening so that a vacuum is drawn through the tube first end into the reservoir and to the source of vacuum. The axis of rotation of the tube is generally parallel to the axis of rotation of the elongated shaft of the vacuum spinning apparatus, so that when the tube is rotated into its second, operative, position the first end of the tube is immediately adjacent the second end of the elongated shaft so that it sucks the connected fibers within the shaft all the way through to the second end thereof. Preferably means are provided responsive to rotation of the vacuum tube from its first to its second positions for cutting out the vacuum applied to the exterior of the elongated shaft when the vacuum tube is moved toward its second position.

According to the present invention a method is also provided of threading an elongated hollow shaft having a first end and a second end, and a through-extending passageway from the first end to the second end. The method comprises the following steps: (a) Feeding connected fibers into the first end of the passageway. (b) Moving a vacuum source into operative association with the second end of the passageway to suck the connected fibers through the passageway so that a segment of connected fibers extends all the way through the passageway. (c) Moving the vacuum source to an inoperative position wherein it is operatively spaced from the passageway; and (d) bringing the segment of connected fibers into operative association with a take-up mechanism spaced from the second end of the shaft. The elongated hollow shaft has at least a portion of the circumference thereof perforated, and a vacuum source is applied to the exterior of the shaft to draw air through the first end of the shaft and the perforations. The vacuum source is temporarily rendered inactive during the practice of step (b), but is reactivated when step (c) is practiced.

It is the primary object of the present invention to provide an efficient and simple method and apparatus for the initial threading of vacuum spinning apparatus. This and other objects of the invention will become clear from an inspection of the detailed description of the invention, and from the appended claims.

DETAILED DESCRIPTION

Figure 1:
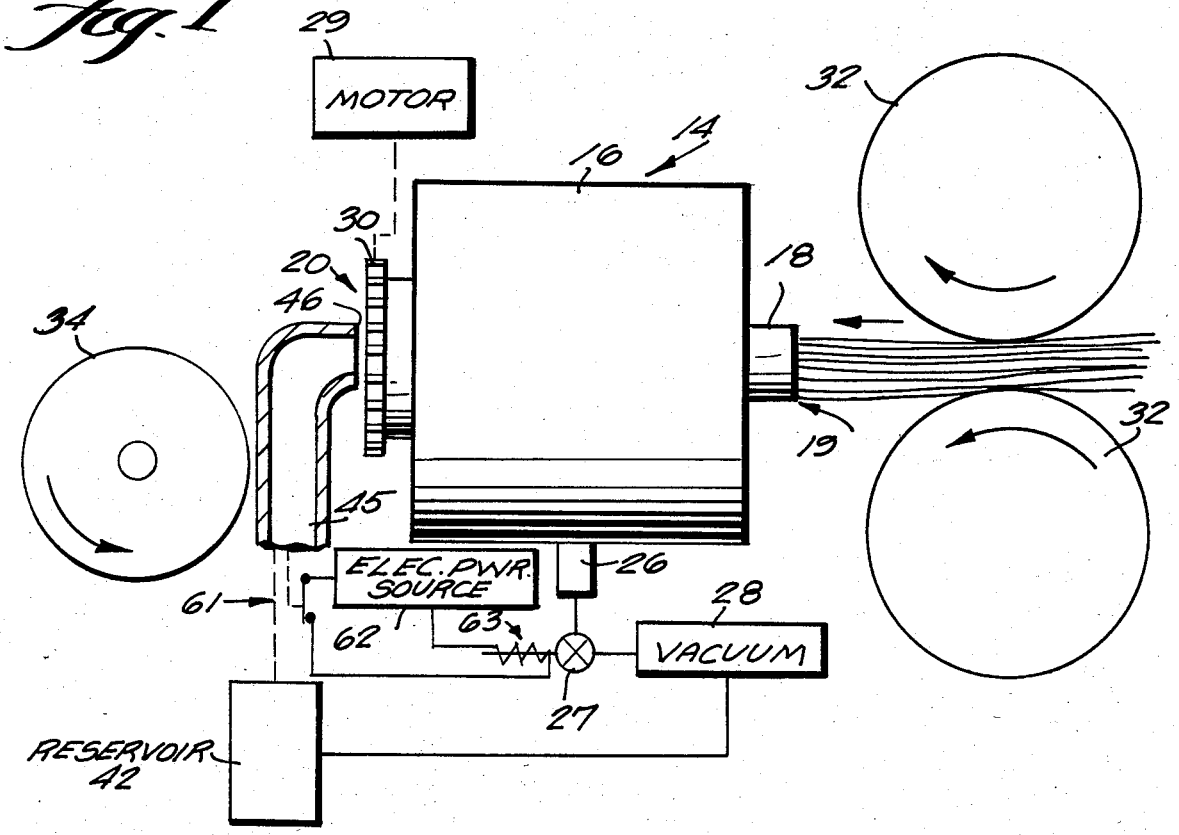
FIG. 1 is a side schematic view showing conventional vacuum spinning apparatus with which the invention is associated in elevation, and showing a portion of a vacuum tube of exemplary apparatus according to the invention in operative association with the vacuum spinning apparatus.
Figure 5:
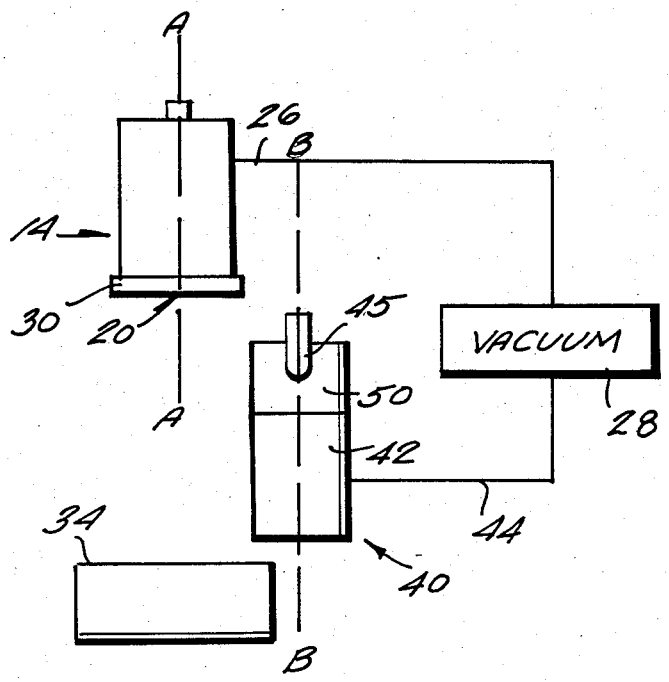
FIG. 5 is a top plan schematic view of the apparatus of FIGS. 3 and 4 mounted in position with respect to the vacuum spinning apparatus of FIG. 1.

Exemplary vacuum spinning apparatus is shown generally by reference numeral 14 in FIGS. 1 and 5. The apparatus 14 is described and illustrated in U.S. Pat. No. 4,507,913 and co-pending application Ser. No. 677,487 filed Dec. 3, 1984, the disclosures of which are hereby incorporated by reference herein.

Figure 2:
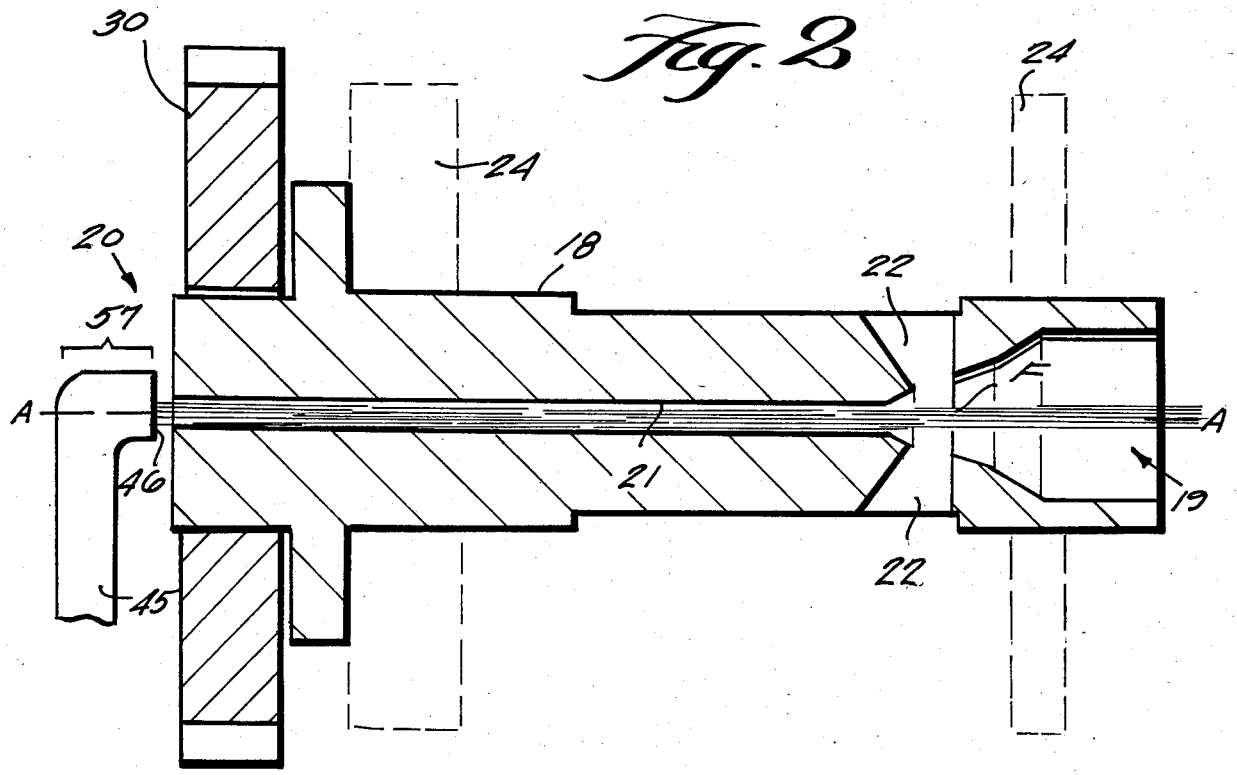
FIG. 2 is a side cross-sectional view of an exemplary vacuum spinning elongated hollow shaft showing a first end of an exemplary vacuum tube according to the present invention in operative association with the vacuum spinning apparatus shaft.

With reference to FIGS. 1, 2, and 5, conventional components of the vacuum spinning apparatus 14 include the housing 16 and an elongated hollow shaft 18 having a first end 19 thereof and a second end 20, with a through-extending passageway 21 (see FIG. 2) from the first end 19 to the second end 20. At least a portion of the circumference of the shaft 18 is perforated, as by perforations 22 (see FIG. 2), which typically would comprise four perforations equally spaced around the circumference of the shaft 18. The shaft 18 is mounted for rotation about an axis A—A, as by bearing means (shown schematically at 24 in FIG. 2) extending between the shaft 18 and the housing 16. The housing 16 is connected up, through conduit 26 and valve 27 (see FIG. 1) to a source of vacuum 28, such as a conventional vacuum pump. The shaft is rotated about the axis A—A by a motor 29, or like power source, which is operatively connected to the shaft 18 through gear 30 or a like standard drive structure such as a pulley or sprocket.

In a typical use of the vacuum spinning apparatus 14, drafting apparatus (not shown) nips a sliver or roving S and feeds the textile fibers of the sliver or roving S (including through a set of feed rolls 32) to the first end 19 of the shaft 18. The vacuum that is applied to the circumferential exterior of the shaft 18 causes an air flow from the first end 19, and through the perforations 22, so that at least some of the fibers or free ends of fibers passing through the shaft will draw toward the shaft perforations 22, and will be caused to rotate with the shaft as the fibers move linearly generally along the axis of rotation A—A. Operatively associated with the second end 20 of the shaft 18 is a conventional take-up mechanism, such as the take-up cone 34 shown schematically in FIGS. 1 and 5.

Figure 3:
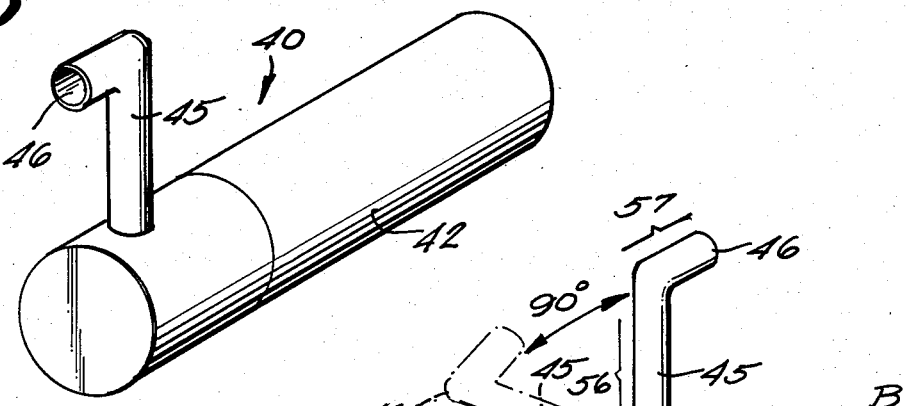
FIG. 3 is a front perspective view of exemplary threading apparatus according to the present invention.
Figure 4:
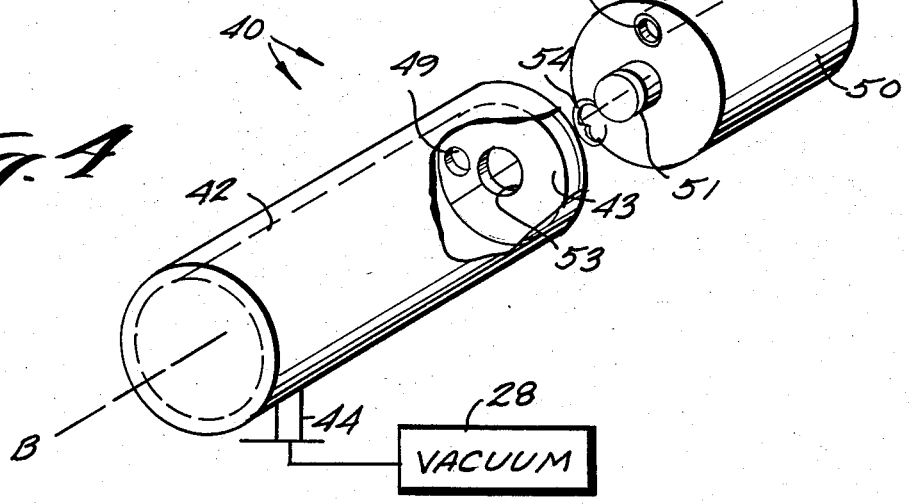
FIG. 4 is a rear perspective exploded view, with portions cut away for clarity, of the apparatus of FIG. 3.

The threading apparatus according to the present invention is shown generally by reference numeral 40 in FIGS. 3 through 5. A first major component of the apparatus 40 is the vacuum reservoir 42, which has walls including a front end wall 43. The reservoir 42 is operatively connected to the source of vacuum 28, as through a conventional conduit means 44.

A second major component of the apparatus 40 comprises a vacuum tube 45. The vacuum tube has an open first end 46, and an open second end 47.

The apparatus 40 also comprises means for defining an opening 49 in the reservoir wall 43, and means for mounting the tube 45 for rotation. In the exemplary embodiment illustrated in the drawings, the means for mounting the tube 45 for rotation comprises the cylinder 50 having a shaft 51 extending outwardly therefrom generally parallel to the second end 47 of the vacuum tube 45, and concentric with the cylinder 50. The shaft 51 passes through bearing opening 53 in the reservoir wall 43, and the free end of the shaft 51 is held within the reservoir 42 by the E-clip 54, or a like attachment mechanism. The vacuum tube 45 has a substantially straight central portion 56, a first end portion 57 which contains the first end opening 46 and which is generally perpendicular to the portion 56, and a second end portion 58 containing the second end opening 47 which is also generally perpendicular to the central portion 56 and generally parallel to the first end portion 57. The second end portion 58 is mounted within the cylinder 50 so that it is off-center; i.e. so that the second end opening 47 is radially spaced from the shaft 51, as seen in FIG. 4.

The cylinder 50, shaft 51, bearing opening 53, and like components comprising means for mounting the tube 45 for rotation, mount the tube 45 for rotation with respect to the vacuum reservoir 42, about the axis B—B, so that the tube 45 is moved from a first, inoperative, position (see FIGS. 3 through 5) wherein it is not in operative communication with the reservoir 42, to a second, operative position (dotted line position in FIG. 4, and the position shown in FIGS. 1 and 2) wherein it is in operative communication with the reservoir 42 due to the fact that the second end opening 47 of the vacuum tube is aligned with the opening 49 in the vacuum reservoir wall 43. In this operative position, the vacuum pulled by vacuum source 28 causes air to flow through the first open end 46 of the vacuum tube 45, all the way through the vacuum tube 45 and through the opening 49 into the reservoir 42, and then ultimately through conduit 44 to the vacuum source 28.

Suitable stop mechanisms (not shown) may be provided on the cylinder 50 and the vacuum reservoir 42 to stop the rotation of the vacuum tube 45 in the operative position wherein the openings 47, 49 are aligned. Additionally, spring means (not shown), such as a torsion spring connected between the shaft 51 and the reservoir wall 43 within the reservoir 42, may be provided to bias the tube 45 to its inoperative position.

It is also highly desirable to prevent a vacuum from being applied to the circumferential exterior of the shaft 18 when the vacuum tube 45 is in its operative position. In its operative position the first open end 46 thereof is immediately adjacent the second end 20 of the shaft 18 and in alignment with the passageway 21, as illustrated in FIGS. 1 and 2. The cut-out of the application of the vacuum source 28 to the housing 16 may be effected by operatively connecting the tube 45 to an electrical switch—shown schematically by reference numeral 61 in FIG. 1—that is responsive to the pivotal movement of the vacuum tube 45 from its inoperative position in its operative position. The switch 61 may be a mercury switch mounted on the tube 45, a reed switch mounted within cylinder 50 and cooperating with a magnet associated with reservoir wall 43, or any of a wide variety of other commercially available structures. The electrical switch 61 is operatively connected to a source of electrical power 62, and to a conventional solenoid operator 63 for the valve 27.

In the exemplary embodiment schematically illustrated in FIG. 1, when the tube 45 is moved to its operative position the switch 61 is closed, causing actuation of the solenoid operator 63 to move value 27 to its closed position so that no vacuum is applied to the interior of the housing 16. When the tube 45 is moved back to its first, inoperative position, the switch 61 opens, deactivating the solenoid actuator 63, so that the valve 27 moves to its normal open position.

As illustrated in FIG. 5, the axis of rotation B—B of the vacuum tube 45 is preferably mounted so that it is parallel to, but horizontally spaced from, the axis of rotation A—A of the hollow shaft 18. Also the vacuum tube 45 is mounted so that it does not interfere with the take-up cone 34, or like take-up mechanism.

OPERATION

In a typical operation of the apparatus according to the present invention, connected fibers F (see FIG. 2) are fed into the first end 19 of the hollow shaft 18. Typically the connected fibers F would be the roving or sliver itself, which may or may not have been subjected to a drafting operation. Once the fibers F are initially fed into the opening 19, the vacuum tube 45 is manually engaged by the operator and moved from its inoperative position (FIGS. 3 and 5 and the solid line position in FIG. 4) to an operative position (FIGS. 1 and 2 and dotted line in FIG. 4), tube 45 rotating about the shaft 51 and axis B—B so that the first open end 46 thereof is adjacent the second end 20 of the shaft 18, and in alignment with the passageway 21. In this position the tube 45 is operatively connected through openings 47 and 49, and vacuum reservoir 42, to the vacuum source 28, and the tube 45 sucks the connected fibers F so that a segment thereof is pulled all the way through the passageway 21 (see FIG. 2). During the manual pivotal movement of the tube 45 to its operative position the switch 61 is closed and the valve 27 closed in response to the switch closure.

Once a segment of the connected fibers F has been sucked completely through the passageway 21, the vacuum tube 45 is moved back to its inoperative position. Then the segment of connected fibers, a portion of which extends outwardly from the second end 20 of the shaft 18, is operatively connected to the take-up cone 34, or a like take-up mechanism. Then the motor 29 is started and the vacuum spinning operation utilizing the apparatus 14 begins.

In the event of the necessity for a rethreading for an "ends down" situation, motor 29 may continue to drive the shaft 18 as rethreading is effected.

It will thus be seen that according to the present invention a simple yet effective apparatus and method for initially threading the elongated hollow shaft of a vacuum spinning apparatus has been provided. While the invention has been herein shown and described in what is presently conceived to be the most practical and preferred embodiment thereof, it will be apparent to those of ordinary skill in the art that many modifications may be made within the scope of the invention, which scope is to be accorded the broadest interpretation of the appended claims so as to encompass all equivalent structures and procedures.

What is claimed is:

1. A threading apparatus comprising:

a vacuum reservoir having walls;

means for connecting said vacuum reservoir to a source of vacuum;

a vacuum tube having first and second open ends;

means for defining an opening in one of said reservoir walls; and means for mounting said vacuum tube for rotation with respect to said reservoir so that said second open end of said tube is movable from a first, inoperative, position wherein it is spaced from said opening to a second, operative, position wherein it is in operative communication with said opening so that a vacuum is drawn through said tube first end into said reservoir and to said source of vacuum.

2. Apparatus as recited in claim 1 wherein said means for mounting said tube for rotation comprises: a cylinder for mounting said vacuum tube; a shaft extending concentrically from said cylinder; and means defining a bearing opening in said vacuum reservoir wall for receipt of said cylinder shaft, said shaft defining an axis of rotation about which said cylinder and said vacuum tube are rotatable.

3. Apparatus as recited in claim 2 wherein said vacuum tube comprises a central portion extending generally perpendicular to said axis of rotation; a first end portion containing said first open end, said first end portion extending generally perpendicular to said central portion; and a second end portion containing said second open end, said second end portion extending generally perpendicular to said central portion and parallel to, but spaced radially from, said axis of rotation.

4. Threading apparatus associated with vacuum spinning apparatus;

said vacuum spinning apparatus comprising: an elongated hollow shaft having a longitudinal axis, a first end and a second end, a through-extending passageway from the first end to the second end, and at least a portion of the entire circumference of the shaft being perforated; means for mounting said shaft for rotation about a first axis; means for rotating said shaft about its axis; means for applying a vacuum, from a vacuum source, to the exterior of said shaft to draw air through said first end of said shaft, and said passageway, through said perforations; means for feeding textile fibers into said passageway from said first end of said shaft; and means for withdrawing formed yarn from said second end of said shaft; and wherein said threading apparatus comprises; a vacuum tube having a first open end thereof, and mounted in operative association with said hollow shaft so that said vacuum tube is pivotally movable about an axis parallel to the longitudinal axis of the shaft from a first, inoperative position wherein the first open end thereof is spaced from said second end of said shaft, to a second, operative position wherein said first open end of said tube is adjacent said second end of said shaft, and in alignment with said passageway; and means for operatively connecting said vacuum tube to a vacuum source when said vacuum tube is in its second, operative position.

5. Apparatus as recited in claim 4 wherein said threading apparatus further comprises: a vacuum reservoir having walls; means for connecting said vacuum reservoir to said source of vacuum; a second open end of said vacuum tube; means for defining an opening in one of said reservoir walls; and means for mounting said tube for rotation with respect to said reservoir so that said tube is movable from its first position wherein said second open end of said tube is spaced from said opening, to its second position wherein said second open end of said tube is in operative communication with said opening so that a vacuum is drawn through said tube first end into said reservoir and into said source of vacuum.

6. Apparatus as recited in claim 5 wherein said means for mounting said tube for rotation comprises: a cylinder for mounting said vacuum tube; a shaft extending concentrically from said cylinder; and means defining a bearing opening in said vacuum reservoir wall for receipt of said cylinder shaft, said shaft defining an axis of rotation about which said cylinder, and said vacuum tube, are rotatable.

7. Apparatus as recited in claim 6 wherein said vacuum tube comprises a central portion extending generally perpendicular to said axis of rotation; a first end portion containing said first open end, said first end portion extending generally perpendicular to said central portion; and a second end portion containing said second open end, said second end portion extending generally perpendicular to said central portion and parallel to, but spaced radially from, said axis of rotation.

8. Apparatus as recited in claim 7 further comprising means responsive to the movement of said vacuum tube from its first position to its second position for terminating application of vacuum to the circumferential exterior of said shaft when said vacuum tube is in its second, operative, position.

9. Apparatus as recited in claim 8 wherein said means responsive to vacuum tube movement for terminating the application of vacuum to the circumferential exterior of the shaft comprises an electrical swith and a solenoid operated valve.

10. Apparatus as recited in claim 4 further comprising means responsive to the movement of said vacuum tube from its first position to its second position for terminating application of vacuum to the circumferential exterior of said shaft when said vacuum tube is in its second, operative, position.

11. Apparatus as recited in claim 10 wherein said means responsive to vacuum tube movement for terminating the application of vacuum to the circumferential exterior of the shaft comprises an electrical switch and a solenoid operated valve.

12. A method of threading an elongated hollow shaft having a longitudinal axis, first and second ends, and a through-extending passageway from the first end to the second end, comprising the steps of:

(a) feeding connected textile fibers into the first end of the passageway;

(b) moving a vacuum source into operative association with the second end of the shaft to suck the connected fibers through the passageway so that a segment of connected fibers extends all the way through the passageway;

(c) moving the vacuum source to an inoperative position; and (d) bringing the segment of connected fibers into operative association with a take-up mechanism spaced from the second end of the shaft, wherein the hollow elongated shaft has perforations in a portion of the circumference thereof and is connected up to a source of vacuum which applies a vacuum to the circumferential exterior of the shaft so that air is drawn through the first end of the shaft, and through the perforations, to the vacuum source; and wherein the method comprises the further step of automatically cutting off the application of vacuum to the exterior of the shaft during the practice of step (b).

13. A method as recited in claim 12 wherein steps (b) and (c) are practiced by pivotally moving a vacuum tube about an axis which is parallel to, but spaced from, the longitudinal axis of the elongated hollow shaft.

14. A method as recited in claim 13 comprising the further step of, after (d), rotating the hollow shaft about its longitudinal an axis, feeding textile fibers into the through-extending passageway from the first end of the shaft generally along the longitudinal axis of the shaft, and withdrawing formed yarn from the second end of the shaft with the take-up mechanism, so that at least some of the fibers or free ends of fibers passing through the shaft will draw toward the shaft perforations under the influence of the vacuum, and will be caused to rotate with the shaft as the fibers move linearly generally along the longitudinal axis of the shaft.

15. A method as recited in claim 12 wherein said vacuum cutting off step is practiced by actuation of an electrical switch in response to movement of the vacuum source, and actuation of a solenoid operated valve in response to the electrical switch actuation.

16. A method of threading a rotatable elongated hollow shaft having an axis of rotation, first and second ends and a through-extending passageway extending from the first end of the second end, comprising the steps of:

(a) feeding connected textile fibers into the first end of the passageway;

(b) moving a vacuum source into operative association with the second end of the shaft to suck the connected fibers through the passageway so that a segment of connected fibers extends all the way through the passageway;

(c) moving the vacuum source to an inoperative position;

(d) bringing the segment of connected fibers into operative association with a take-up mechanism spaced from the second end of the shaft; and wherein steps (b) and (c) are practiced by pivotally moving a vacuum tube about an axis which is parallel to, but spaced from, the axis of rotation of the elongated hollow shaft.

17. A method of threading a rotatable elongated hollow shaft having an axis of rotation, first and second ends, and a through-extending passageway extending from the first end to the second end, comprising the steps of:

(a) feeding connected textile fibers into the first end of the passageway;

(b) pivotally moving a vacuum source about an axis parallel to but spaced from the axis of rotation of the elongated hollow shaft into operative association with the second end of the shaft to suck the connected fibers through the passageway so that a segment of connected fibers extends all the way through the passageway;

(c) moving the vacuum source to an inoperative position; and (d) bringing the segment of connected fibers into operative association with a take-up mechanism spaced from the second end of the shaft; and then (e) rotating the hollow shaft about the axis of rotation, feeding textile fibers into the through-extending passageway from the first end of the shaft generally along the axis of rotation of the shaft, and withdrawing formed yarn from the second end of the shaft with the take-up mechanism, so that at least some of the fibers or free ends of fibers passing through the shaft will draw toward the shaft perforations under the influence of the vacuum, and will be caused to rotate with the shaft as the fibers move linearly generally along the axis of rotation of the shaft.

18. A method as recited in claim 17 wherein the hollow elongated shaft has perforations in a portion of the circumference thereof and is connected up to a source of vacuum which applies a vacuum to the exterior of the shaft so that air is drawn through the first end of the shaft, and through the perforations, to the vacuum source; and wherein the method comprises the further step of automatically terminating the application of vacuum to the circumferential exterior of the shaft during the practice of step (b).

19. A method of rethreading a rotating elongated hollow shaft having first and second ends and a through-extending passageway from the first end to the second end wherein yarn is being produced by the rotating hollow shaft from textile fibers fed into the first end of the passageway, and by a vacuum applied to the circumferential exterior of the shaft to draw air through the first end of the shaft and through generally radially extending perforations in the shaft, to the exterior of the shaft, comprising the steps of:

while rotation of the shaft continues, moving a vacuum source into operative association with the second end of the shaft to suck connected textile fibers within the passageway through the passageway so that a segment of connected fibers extends all the way through the passageway;

at the time of moving the vacuum source into operative association with the second end of the shaft, terminating the application of vacuum to the circumferential exterior of the shaft;

moving the vacuum source to an inoperative position, and at the same time restarting application of vacuum to the circumferential exterior of the shaft; and bringing the segment of connected fibers into operative association with a take-up mechanism spaced from the second end of the shaft.

* * * * *